United States Patent [19]

DiMatteo et al.

[11] Patent Number: 4,679,259

[45] Date of Patent: Jul. 14, 1987

[54] RECLINABLE WHEELCHAIR APPARATUS

[75] Inventors: Paul DiMatteo, Huntington; Charles F. Chubb, Brookville, both of N.Y.

[73] Assignee: Nova Technologies, Inc., Hauppauge, N.Y.

[21] Appl. No.: 750,913

[22] Filed: Jul. 1, 1985

Related U.S. Application Data

[63] Continuation-in-part of Ser. No. 731,533, May 7, 1985.

[51] Int. Cl.[4] ..... A61G 7/08

[52] U.S. Cl. ..... 5/81 R; 5/81 C; 297/DIG. 4

[58] Field of Search ..... 5/60, 61, 66, 67, 81 R, 5/81 B, 81 C, 90, 444, 486, 487; 297/330, 437, DIG. 4, DIG. 6

[56] References Cited

U.S. PATENT DOCUMENTS

| | | | |
|---|---|---|---|
| 378,220 | 2/1888 | Staples et al. | 5/81 B |
| 2,536,707 | 1/1951 | Allyn | 5/81 B |
| 2,591,911 | 4/1952 | Block | 297/437 |
| 2,903,043 | 9/1959 | Kenney | 5/81 B |
| 2,959,792 | 11/1960 | Haugard | 5/81 R |
| 3,645,643 | 4/1972 | Clanan | 5/81 B |
| 3,810,263 | 5/1974 | Taylor et al. | 5/81 R |
| 3,987,328 | 7/1976 | Cox | 5/81 R |
| 4,222,132 | 9/1980 | Crim et al. | 5/81 C |
| 4,285,541 | 8/1981 | Onishi | 5/81 R |
| 4,287,619 | 9/1981 | Brewer et al. | 5/90 |
| 4,369,533 | 1/1983 | Gisiger | 5/81 C |
| 4,383,713 | 5/1983 | Roston | 297/DIG. 6 |
| 4,479,993 | 10/1984 | James | 5/61 |

FOREIGN PATENT DOCUMENTS

| | | | |
|---|---|---|---|
| 227483 | 10/1958 | Australia | 5/67 |
| 2100122 | 12/1982 | United Kingdom | 5/61 |

*Primary Examiner*—Gary L. Smith
*Assistant Examiner*—Michael F. Trettel
*Attorney, Agent, or Firm*—Max Fogiel

[57] ABSTRACT

A reclinable wheelchair which operates in conjunction with a compatibly equipped bed to transport a supine person between the bed and the reclined wheelchair. The back rest can be raised and the leg rest lowered to place the person in a sitting position. Provisions are included for use with a toilet.

31 Claims, 32 Drawing Figures

RECLINABLE WHEELCHAIR APPARATUS

BACKGROUND OF THE INVENTION

The present application is a continuation-in-part of the parent application Ser. No. 731,533 filed May 7, 1985.

The process of transferring an invalid person from a hospital bed to a wheelchair, to a commode, or to a toilet in a hospital, nursing home, or home, or assisting such a person in such a transfer, often involves more than one person, is labor intensive and can be costly. The task frequently requires considerable strength and is occasionally a source of injury to the person, nurse, or attendant. These problems often are the major factors that cause a person to be hospitalized or moved to a nursing home, rather than being cared for at home. They also increase the cost of caring for persons in hospitals and nursing homes.

Accordingly, it is the primary object of the present invention to provide a wheelchair which, in combination with a suitably equipped bed, comprises an arrangement whereby a person can be easily, safely, and comfortably transferred between a bed and a wheelchair with no effort on the part of the person and without requiring more than moderate physical strength or skill from an attendant.

It is another object of the present invention to provide means for the person to make use of a commode in the wheelchair or use of a toilet after the wheelchair has been positioned over a toilet bowl.

It is still another object of the present invention to provide a wheelchair which is suitable for use in a home, or outdoors, as well as in a hospital or nursing home.

Additional objects and advantages of the present invention will become evident from the following description of specific embodiments when read in connection with the accompanying drawings.

DESCRIPTION OF THE PREFERRED EMBODIMENTS

Figure 1:
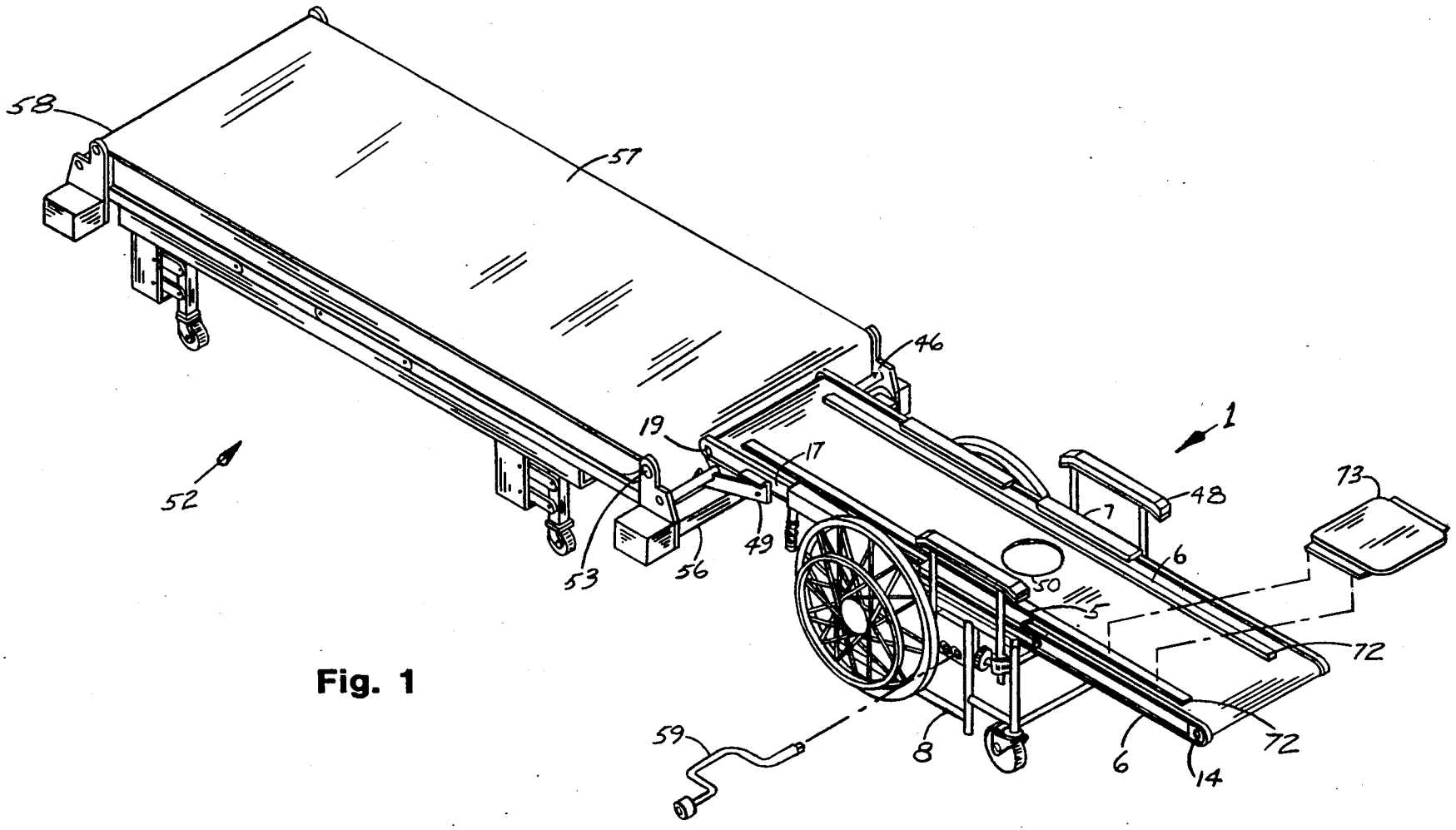
FIG. 1 is a perspective view of a person transfer arrangement and shows an inclined wheelchair and a bed, each is equipped with a transfer mechanism, capable of transferring a person from the bed to the wheelchair.
Figure 2A:
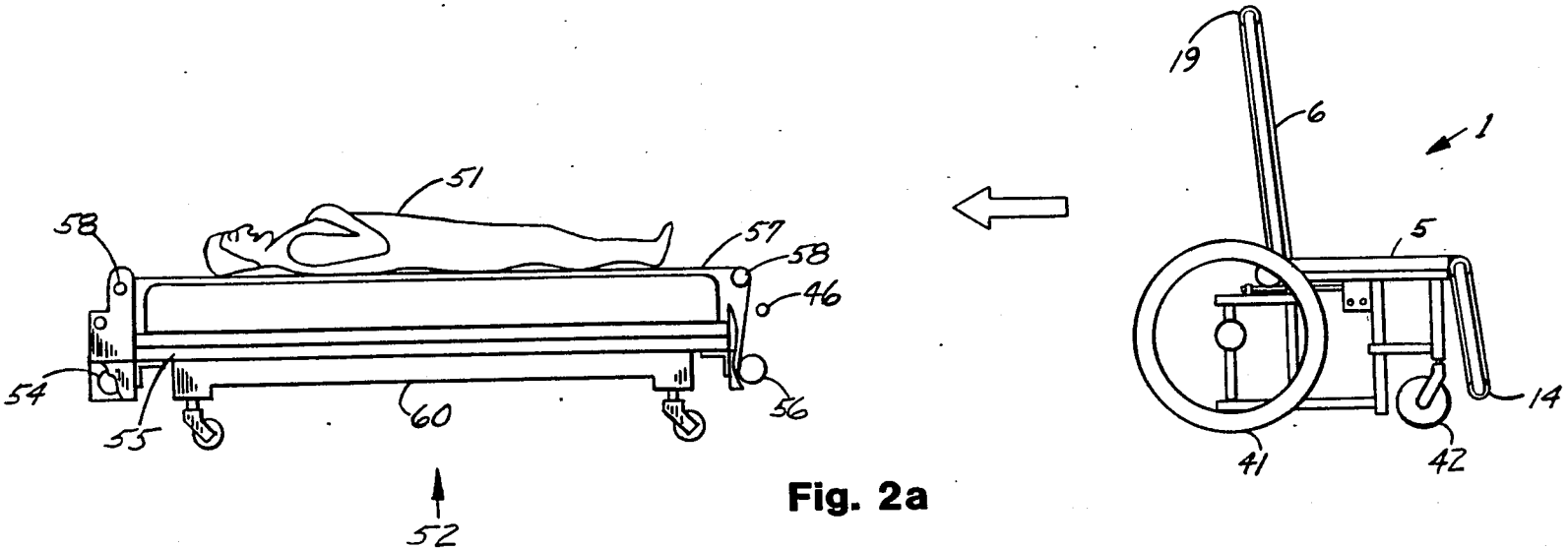
FIGS. 2*a* through 2*h* are schematic drawings which show the steps in transferring a person from a bed to a wheelchair under the principles of the present invention.
Figure 2B:
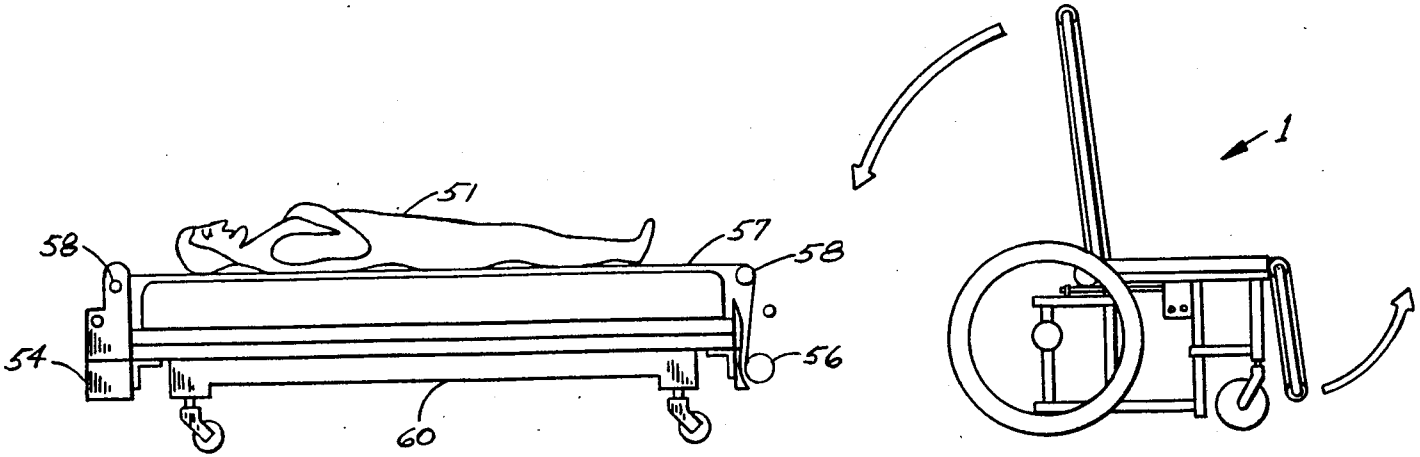
Figure 2C:
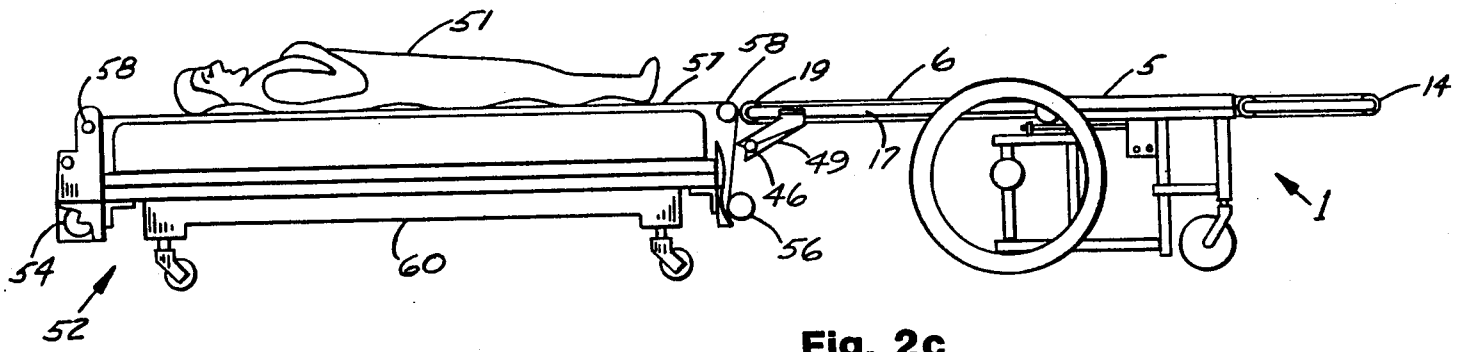
Figure 2D:
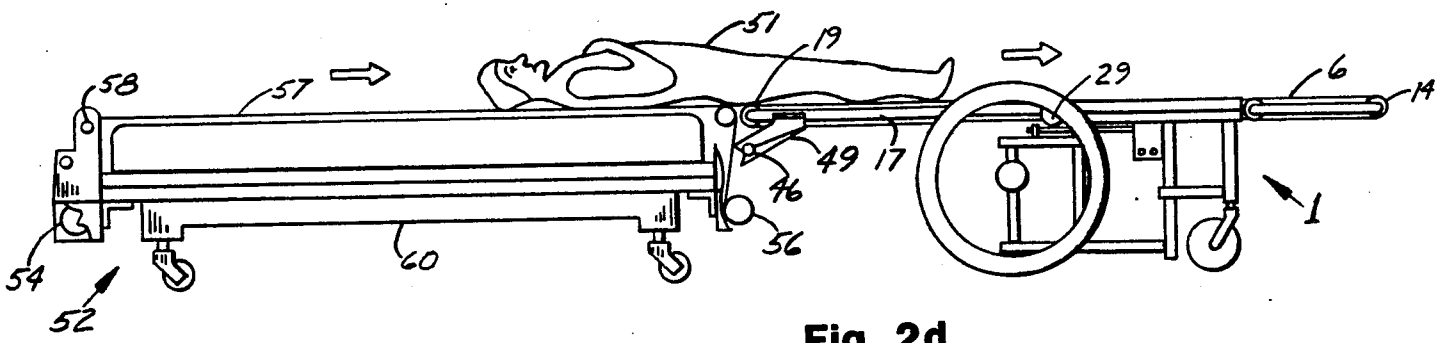
Figure 2E:
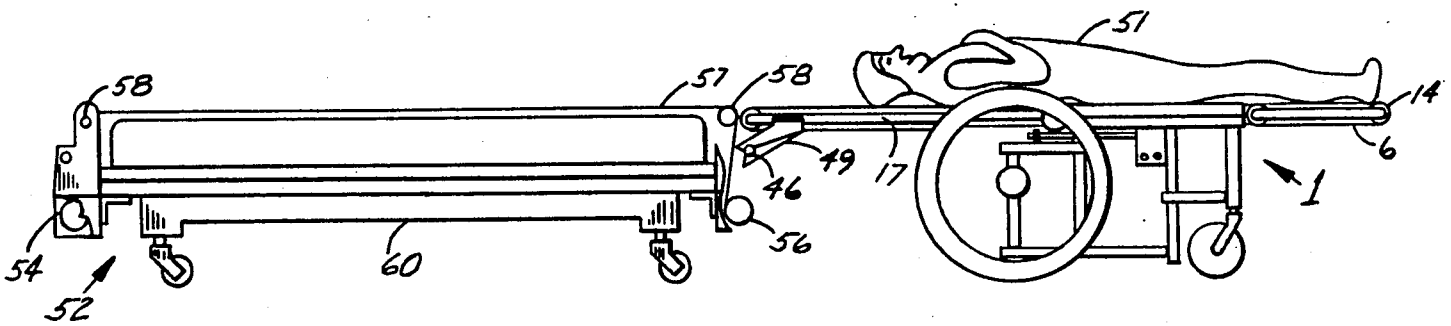
Figure 2F:
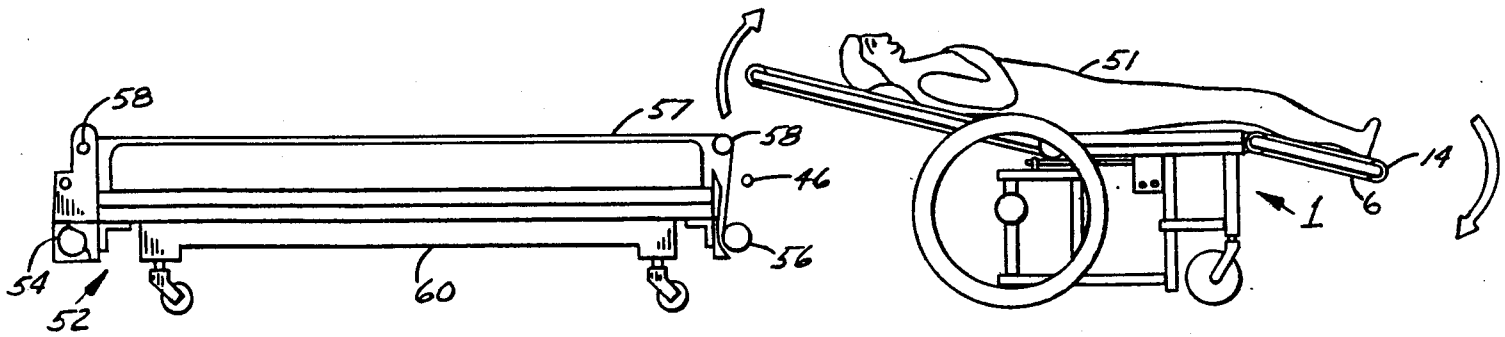
Figure 2G:
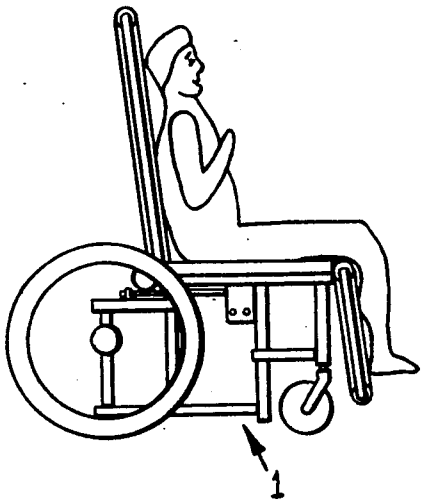
Figure 2G:
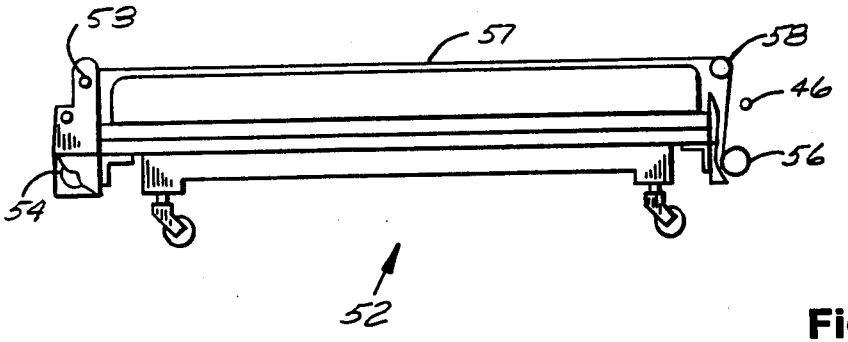
Figure 2H:
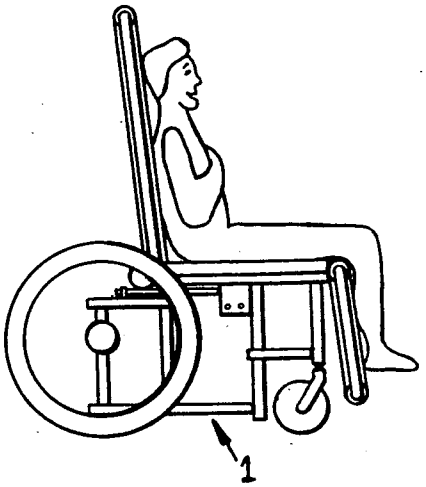
Figure 2H:
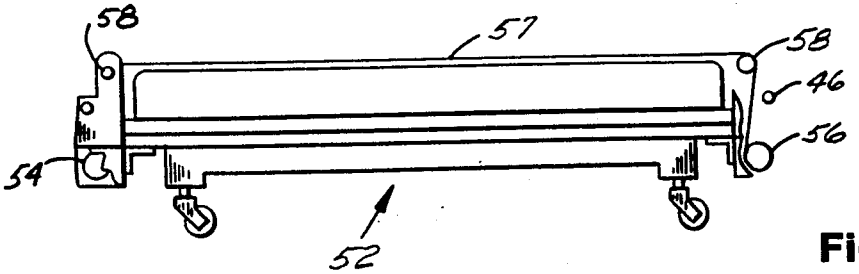

FIG. 1 shows a perspective view of a reclinable wheelchair 1 which is the subject of the present invention, in its reclined position and attached with a latching mechanism 49 to a bed 52. The bed is equipped with a transport sheet mechanism by which a person 51 (shown in FIG. 2) reclining on the bed can be transported over to and onto the reclined wheelchair 1. The surface of the wheelchair is in the form of an endless belt 6 which can be driven to transport the person fully onto the wheelchair.

In accordance with FIG. 1, bed 52 is illustrative of a conventional bed found in a home or hospital, except that attached to it is an arrangement for transporting a person from a position on the bed to and beyond the end of the bed. This arrangement contains a head end roller 54 (shown in FIG. 2*a*) whose length is approximately equal to the width of the bed, and which is mounted to the bed frame at the head end of the bed. A similar foot end roller 56 is positioned at the foot end of the bed. A specially designed bed sheet 57 approximately equal in width to the bed and equal in length to several multiples of the length of the bed, is fastened to and partially rolled up on the head end roller 54 while the other end is fastened to the foot end roller 56 at the foot end of the bed. Idler rollers 58 are used to guide sheet 57 across the ends of the mattress to the head and foot end rollers. Electric motors or hand cranks (not shown) are provided for driving the two rollers to wind up the sheet on one roller while unwinding it from the other so as to move the sheet over the surface of the mattress and thereby transport a reclining person from a position on the bed 52 to and beyond the end of the bed.

On the wheelchair 1, an endless belt 6, which has a flexible surface for seating comfort, passes over head roller 19 and foot roller 14. The belt is supported along the seat area by side guide rails 5 and 7, and is driven through roller 29 (shown in FIG. *2d* and elsewhere) by means of hand crank 59, or a motor as described later. Belt 6 also contains two toilet access holes 50 which, with other details, are also discussed later.

FIGS. *2a* through *2h* schematically illustrate the steps of transporting a person 51 longitudinally from a reclining position on a bed 52 to a seated position on a reclinable wheelchair 1.

In FIG. *2a*, a wheelchair 1 is shown in a position away from a bed 52. In FIG. *2b*, the wheelchair 1 is shown after being positioned manually at the end of the bed 52 and in FIG. *2c*, the wheelchair 1 is shown in a reclined position at the end of the bed 52. The reclined position, as described later, can be achieved by either manual (handcrank) or motorized means.

An elevation mechanism 60, schematically representative of an elevation mechanism associated with a hospital bed, is used to adjust the height of the bed 52 to the height of the wheelchair 1 prior to the transfer of a person.

FIG. *2c* illustrates the bed 52 and the wheelchair 1 at the same elevation and joined together by means of the latching mechanism 49. This mechanism is a preferred means of keeping the wheelchair securely fastened to the bed during the person transfer operation. Alternatively, wheel brakes, (not shown) which are standard devices on beds and wheelchairs and which are included on the bed and wheelchair in this invention, can be used to hold the bed and wheelchair fixed during person transfer. A suitable support mechanically connected to the bed or resting on the floor can be used to prevent the wheelchair from tipping backwards during person transfer.

FIG. *2d* shows the action of simultaneously rotating roller 56, which winds up the sheet and draws it over the bed, and roller 29, which propels the belt over the surface of the wheelchair. The motion of the sheet 57 and belt 6, which transfers the person 51 from the bed to the wheelchair 1, is indicated by the arrows. During this process, roller 54 rolls freely to unwind the sheet as it is drawn across the bed. Completion of the transfer is shown in FIG. *2e*.

FIGS. *2f* and *2g* indicate the operation of raising the person to an upright seated position by means of the mechanism to elevate the back of the chair, which is described later. FIG. *2h* shows the transfer completed and the person being moved away.

The reverse action of transferring the person from the seated position on the wheelchair 1 to a reclining position on the bed 52, can be accomplished by reversing the sequence from FIG. *2h* to FIG. *2a* provided that rollers 54 and 19 are mechanically rotated counterclockwise and roller 56 is allowed to rotate freely as required.

Figure 3:
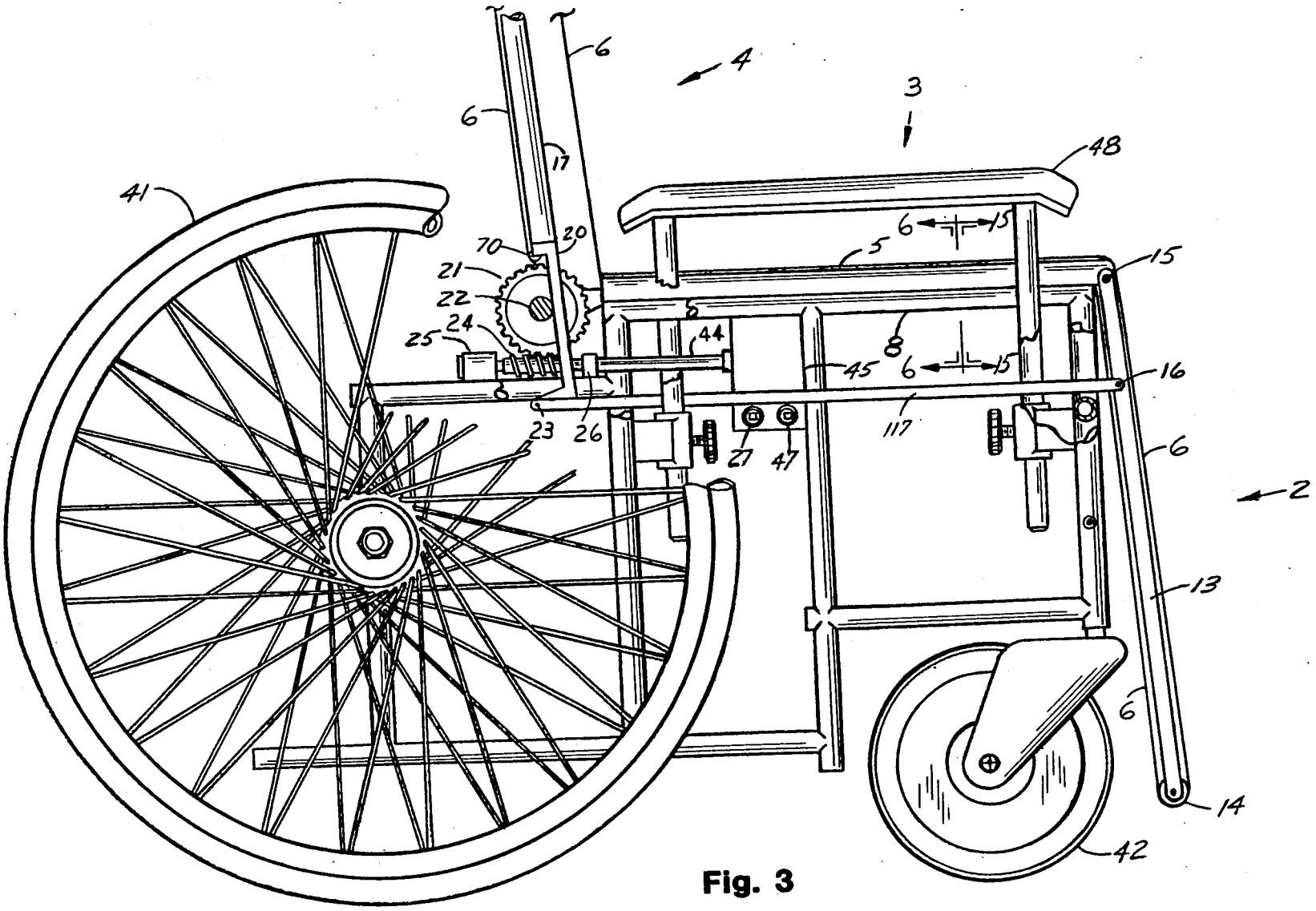
FIG. 3 is a partial elevation section view of the wheelchair in its normal or seating position (less complete back rest)
Figure 4:
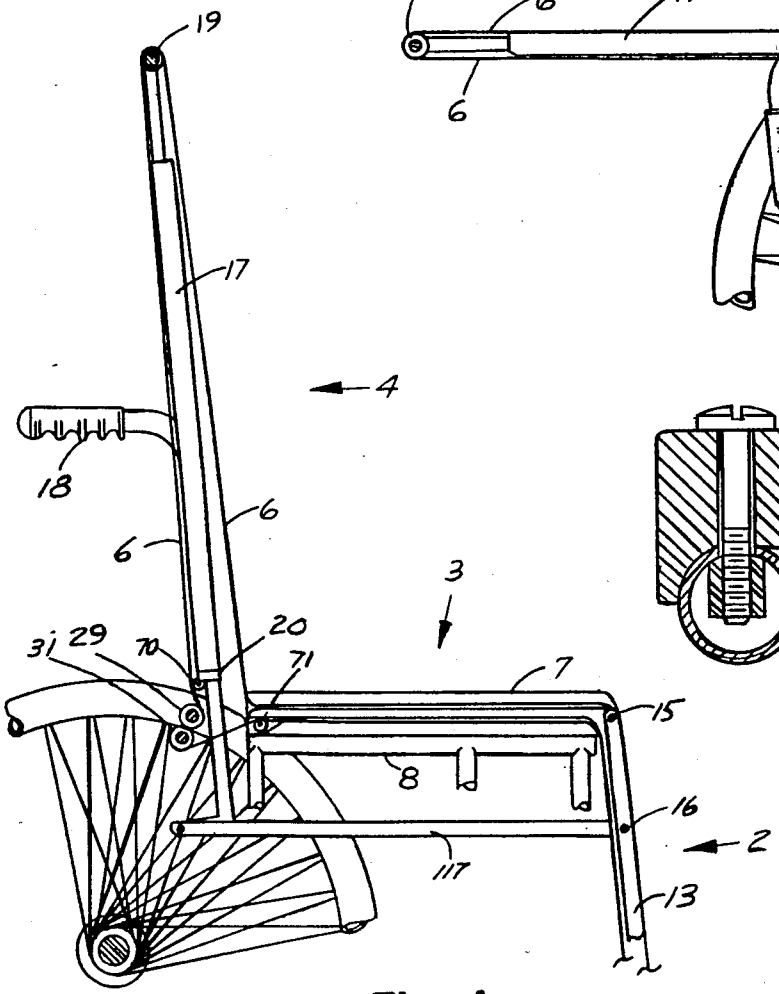
FIG. 4 is a partial elevation section of the wheelchair and shows back rest, seating area and leg support in their normal seating positions.

The wheelchair 1 is shown in its reclined position in a perspective view in FIG. 1 and in its elevated position in partial side elevation views in FIGS. 3 and 4. It differs from a conventional wheelchair in that it contains a flexible belt 6 in place of the fixed seat material which is normally used on wheelchairs. The belt supports the person (not shown) in three areas: a leg rest assembly 2, a seating area 3, and a back rest assembly 4.

Figure 5:
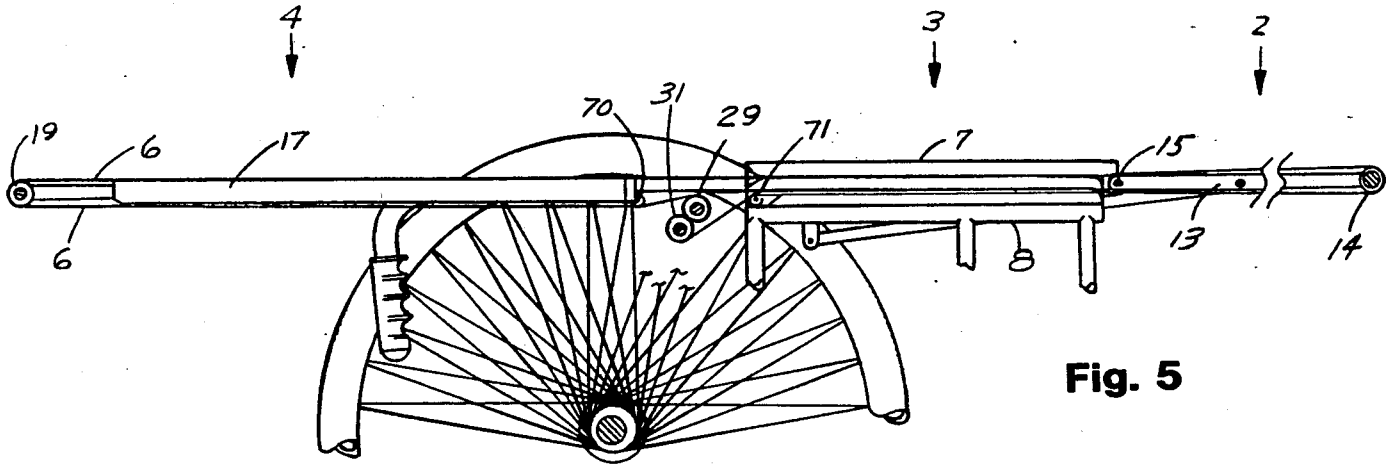
FIG. 5 is a partial elevation cross section of the wheelchair in its reclining position.

FIG. 4, which is a partial sectional side view of the wheelchair in its elevated position, and FIG. 5, which is a partial sectional side view of the wheelchair in its reclined position, show the path of belt 6, which passes around upper roller 19 at the end (or top) of the back assembly 4, along the back rest frame 17 through the upper groove in each of the side guide rails 7 and 5 (not shown). These extend along the sides of the seating area 3, along the top of leg rest assembly 2, over the foot roller 14 (not shown in FIG. 4), back along the bottom of the leg rest assembly, through a lower groove in each said side guide rail, over idler roller 71, under around and between pressure roller 31 and drive roller 29, under idler roller 70, and returning to the upper roller 19 to form an endless belt loop.

In the seating area 3, as shown in FIGS. 4 and 5, the belt 6 is supported by side guide rails 7 and 5 (not shown) mounted to the side tubular members of frame 8. As shown in the sectional view of FIG. 6 and perspective FIG. 7, the belt 6 is made up of a thin center section 9 with a thickened hem-like edge or thick edge 10 on each side of the center section 9. This thick edge 10 fits in a shaped groove 11 in each of the side guide rails 5 and 7. A thin slot 12 (in each side guide rail) allows the center section of the belt 6 to slide but prevents the thick edge of belt 6 from passing through and supports the weight of the person (not shown) in the seating area 3. Each of the side guard rails 5 and 7 has two shaped grooves 11 and two thin slots 12 to support both the lower and upper sections of the belt 6 over the seating area.

Figure 7:
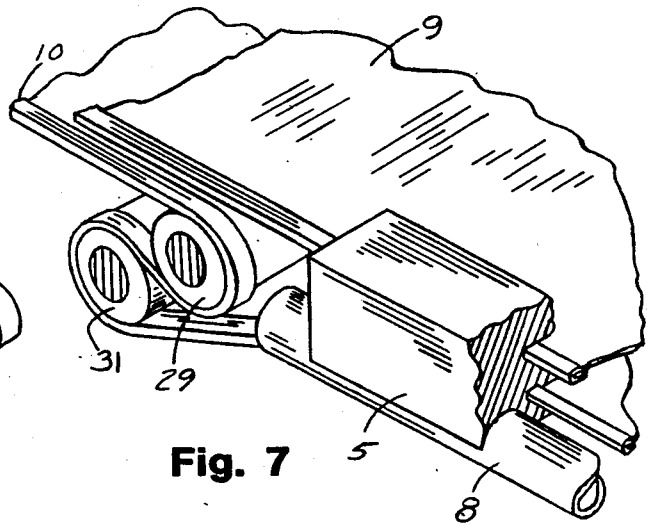
FIG. 7 is a partial perspective view of the belt and the side guide rail which supports the belt.

FIG. 7 shows drive roller 29 and pressure roller 31 which have conventional cylindrical shapes. FIG. *7a* shows, in reduced scale, an altenate configuration in which the center portions of roller 31 and 29 have reduced diameters to enable pads, covers, Velcro strips or other material on the surface of the belt, as described later, to pass freely between the rollers. In both configurations 7 and *7a*, the belt is driven by pressure on its thickened edges.

Figure 8:
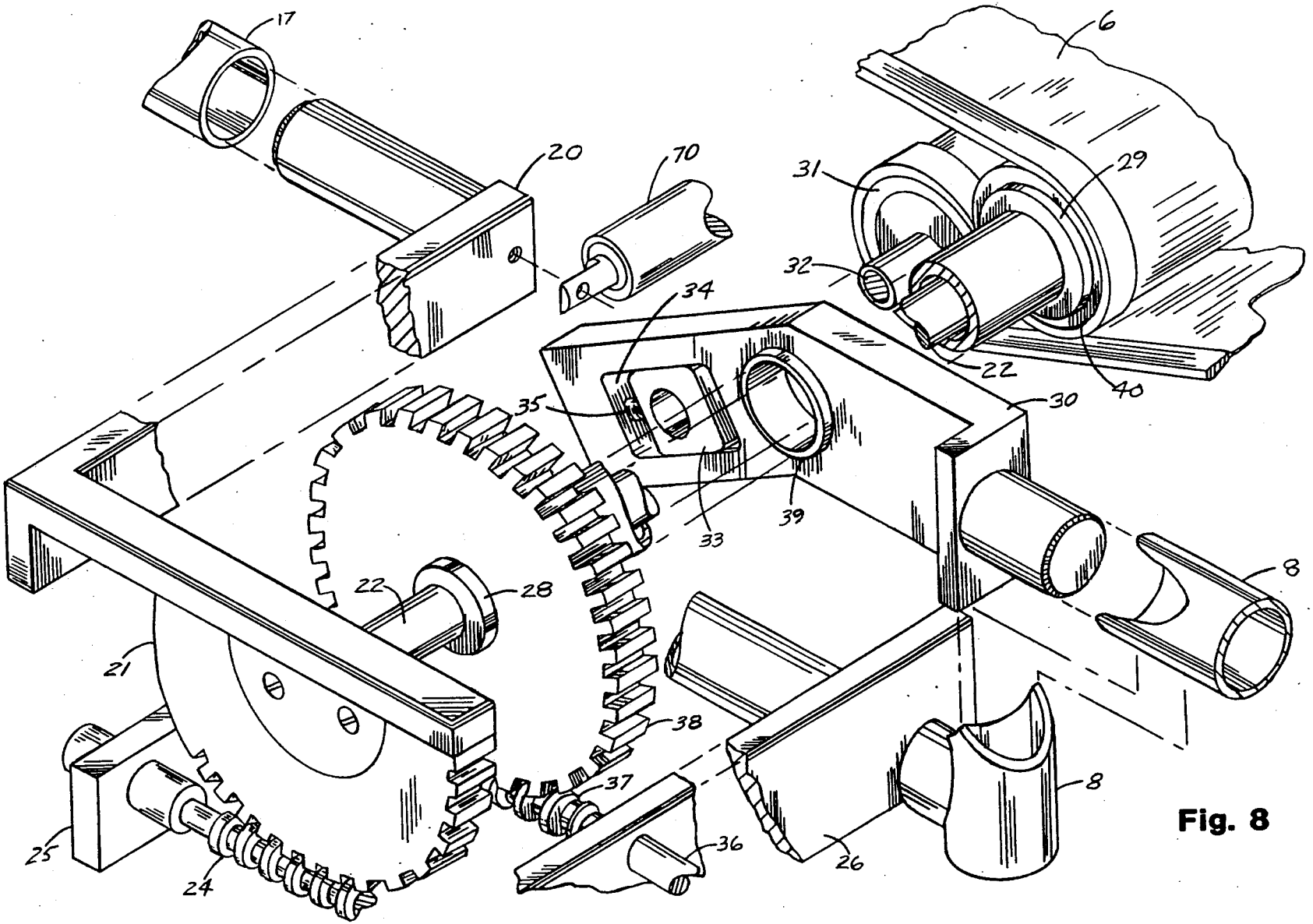
FIG. 8 is a perspective view showing the mechanism for raising and lowering wheelchair back and driving the transport belt.

As shown in FIG. 3 the leg rest assembly 2 consists of a frame 13 supporting a roller 14 about which the belt 6 passes. The leg rest assembly is attached by pivots 15 to the side guide rails 5 and 7 (not shown) which are fastened to the side members of the frame 13, on each side. Leg rest assembly 15 is also fastened to connecting link 117 by pivot 16. As shown in FIG. 4, the back rest assembly 4 consists of a frame 17 with attached handles 18 for pushing the chair, an upper roller 19, around which the belt 6 passes, and a pair of rear support brackets of which only the nearest rear support bracket 20 is shown. As shown in FIGS. 3 and 8, the rear support bracket 20 is fastened to lift worm gear 21, and in FIGS. 8 and 9 this is shown fastened to through-shaft 22. On the opposite sides of the wheelchair, the back rest is connected to shaft 22 in a similar manner (not shown) by parts which are similar to back support bracket 20 and lift worm gear 21. (Of course, no worm gear teeth are required on the far side since shaft 22 is driven as described above.) The back rest assembly pivots on shaft 22 which is attached via bearings (described later) to side frame 8.

As shown in FIG. 3, connecting link 117 is attached to the rear support bracket 20 by pivot 23 and to the leg rest by pivot 16, so that link 115 completes a 4 bar linkage. From the geometry, as shown in FIG. 3, as the back rest frame 17 reclines to the left, the leg rest frame 13 will rise up to the right to the final horizontal position as shown in FIG. 5. This action will place the wheelchair in a basically horizontal position, as indicated in the partial sectional view in FIG. 5, with belt 6 passing around the head end roller 19, across the top surface of the reclined back rest assembly 4, across the seating area 3 where it is supported by side rails 5 and 7, around the foot roller 14 and back along the bottom through the lower grooves in side guide rails 5 and 7, and around rollers 71, 31, 29, and 70 to upper roller 19.

Figure 10:
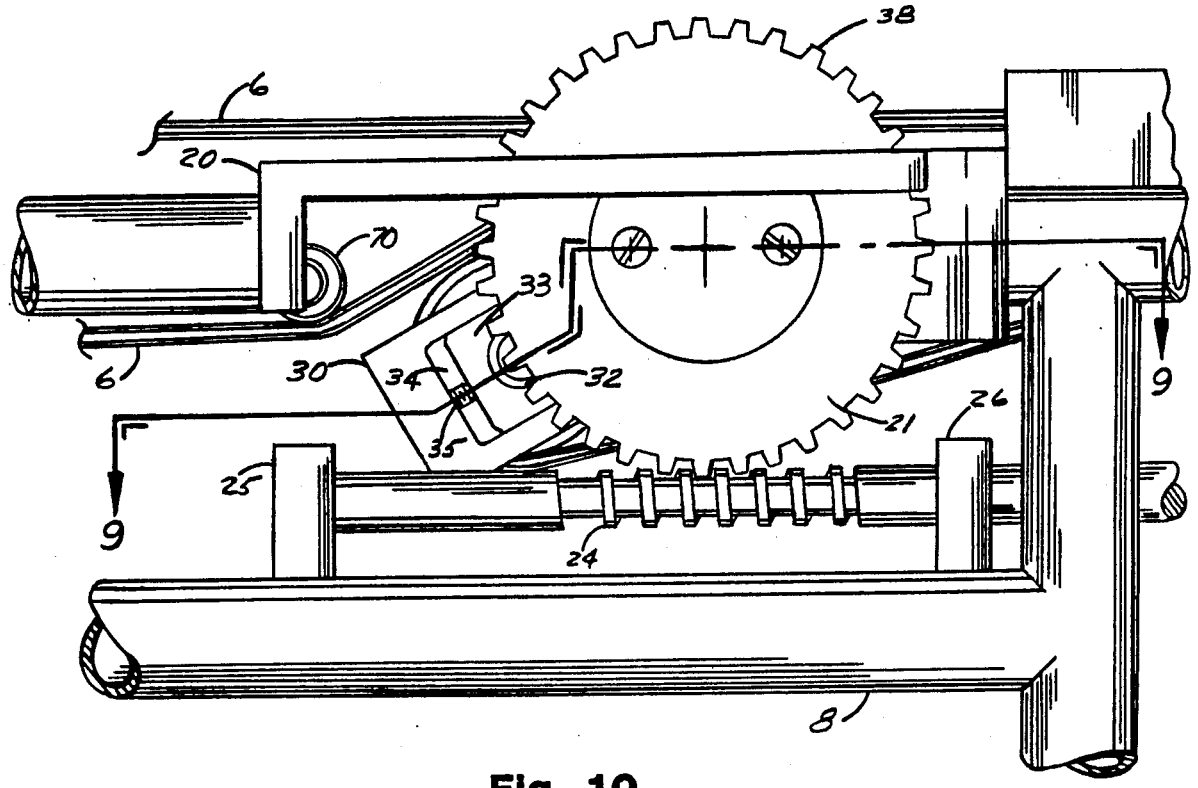
FIG. 10 an elevation view of the mechanism used for raising and lowering the wheelchair back and driving the transport sheet.

FIG. 3 and FIG. 8, which is an expanded perspective view of the back rest lift and the belt-driven mechanisms, show that to raise and lower the back rest 4 and leg rest 2 the worm gear 21 must be driven by lift worm 24 which is held in proper mesh with worm gear 21 by supports 25 and 26 attached to side frame 8. FIG. 10 shows these parts in a partial elevation side view. FIG. 3 shows lift worm 24 connected through shaft 44 and gear box 45 to the lift crank receptacle 27, which can be turned with a hand crank to move the back and foot rests.

Figure 9:
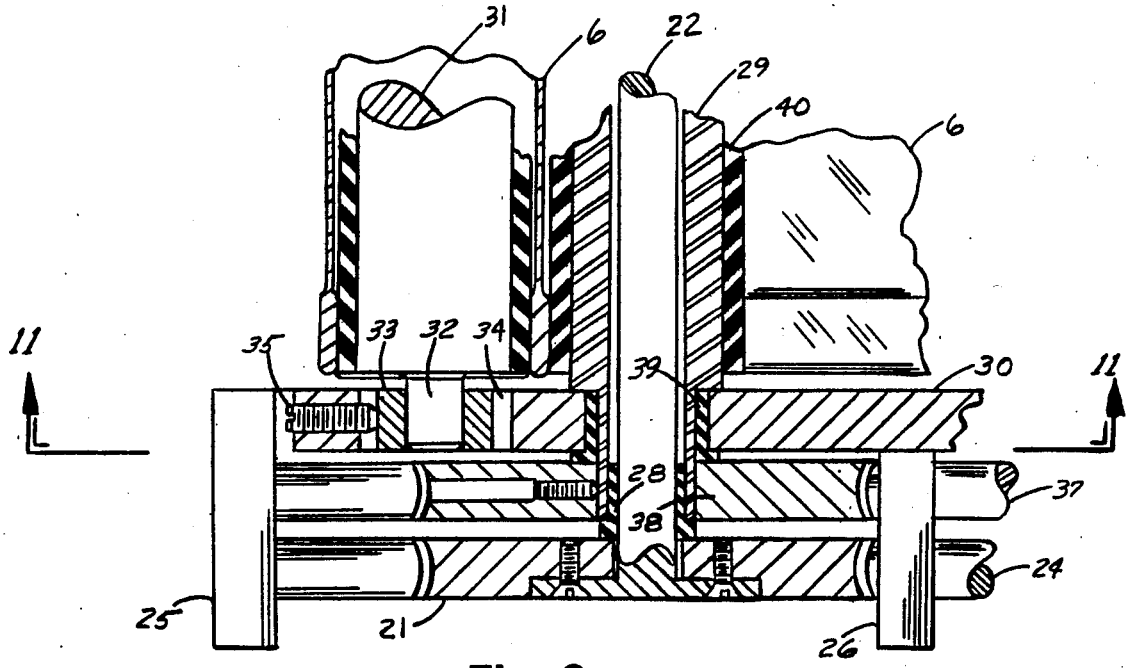
FIG. 9 is a section through FIG. 10.

FIG. 8, and FIG. 9, which is a cross section view through the axes of the lift and belt drive mechanisms as indicated in FIG. 10, show that worm gear 21, to which rear support 20 is fastened, is connected to and pivots about through shaft 22. This shaft is supported in bearings 28 which in turn are seen to be concentric with and supported by the extended hollow shaft of drive roller 29 and the transport system support member 30 which is mounted to side frame member 8. FIGS. 8 and 9 show the belt drive mechanism. Provided that belt 6 has sufficient pressure from roller 31 and sufficient friction with drive roller 29, then drive roller rotation will propel belt 6 to carry a person onto or off the chair as described elsewhere in this document.

Figure 11:
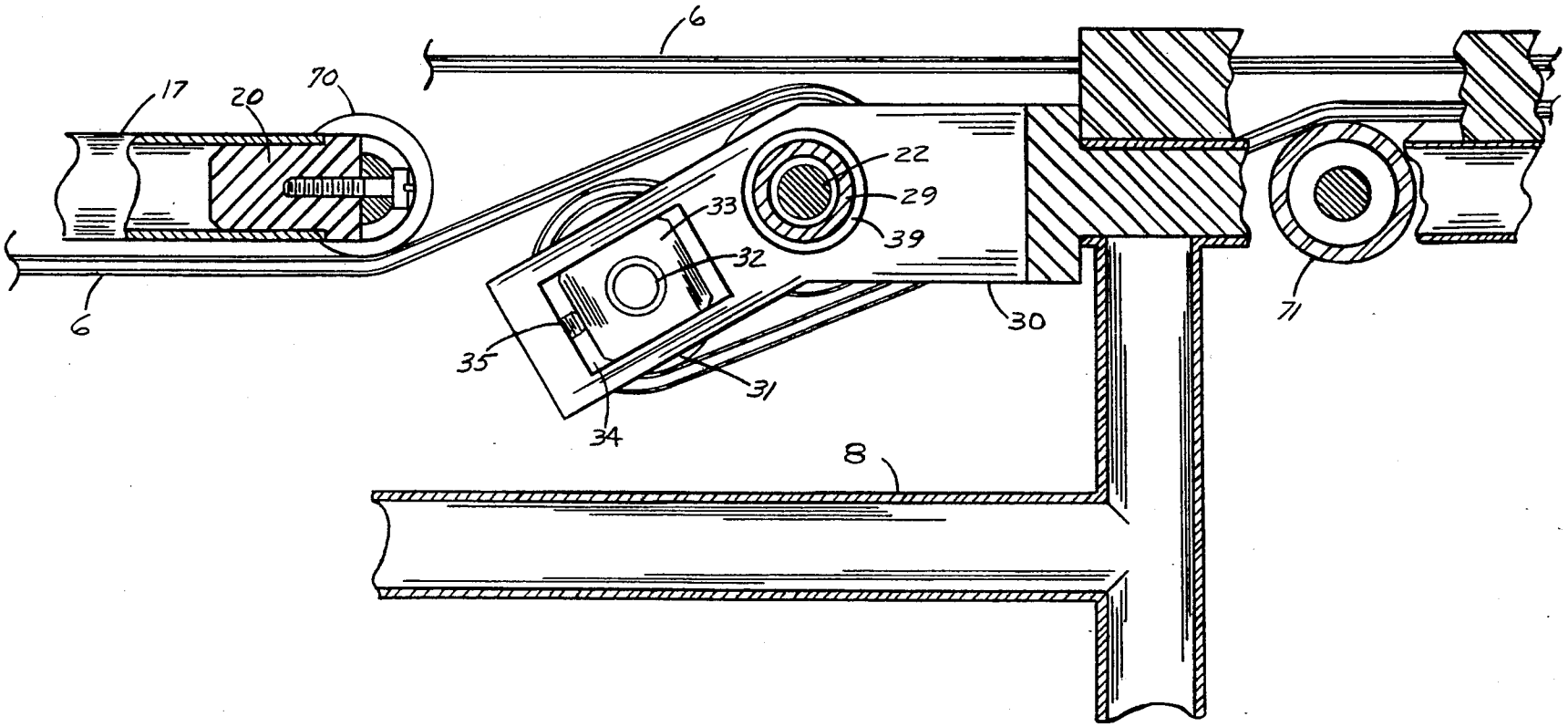
FIG. 11 is a section through FIG. 9.

As shown in FIG. 8 and FIG. 11, which is a sectional elevation view of the belt drive system, the pressure roller shaft 32 is mounted in an adjustment slide 33 that, in turn, is mounted in a slot 34 in the transport system support 30. There is an adjustment screw 35 which can be rotated to move slide 33 and thereby roller 31 to apply the proper pressure against sheet 6 between rollers 29 and 31. This bracket and adjustment system is repeated on the far side of the chair (not shown). FIG. 11 also shows guide roller 71, which is mounted by a bracket (not shown) to frame 8 at the base of the seat. Roller 71 may be used to aid in guiding the lower layer of belt 6 into the guidance grooves in guide rails 5 and 7. FIGS. 8 and 11 show idler roller 70, which is mounted on rear support brackets 20 and may be used to aid in guiding the lower layer of the belt to the drive rollers.

FIGS. 8 and 9 show how the drive roller 29 is rotated. Drive worm 37, which is supported in bearings by supports 25 and 26 and is meshed with worm gear 38, is connected by shaft 36 through gear box 45 (shown in FIG. 3) to belt crank receptacle 47. Worm gear 38 rotates around the concentric through shaft 22 via bearing 28 and inside bearing 39, which is mounted in support member 30. Worm gear 38 is rigidly fastened to the shaft extension of drive roller 29, the outer surface 40 of which consists of a layer of material or a scored surface having a high enough coefficient of friction to drive belt 6. The bracket 30 and bearings 39 and 28 are duplicated on the far side of the chair (not shown). A hand crank driving the receptacle 47, or a motor as described later will act through worm 37, worm gear 38, and roller 29 to propel belt 6.

Figure 12:
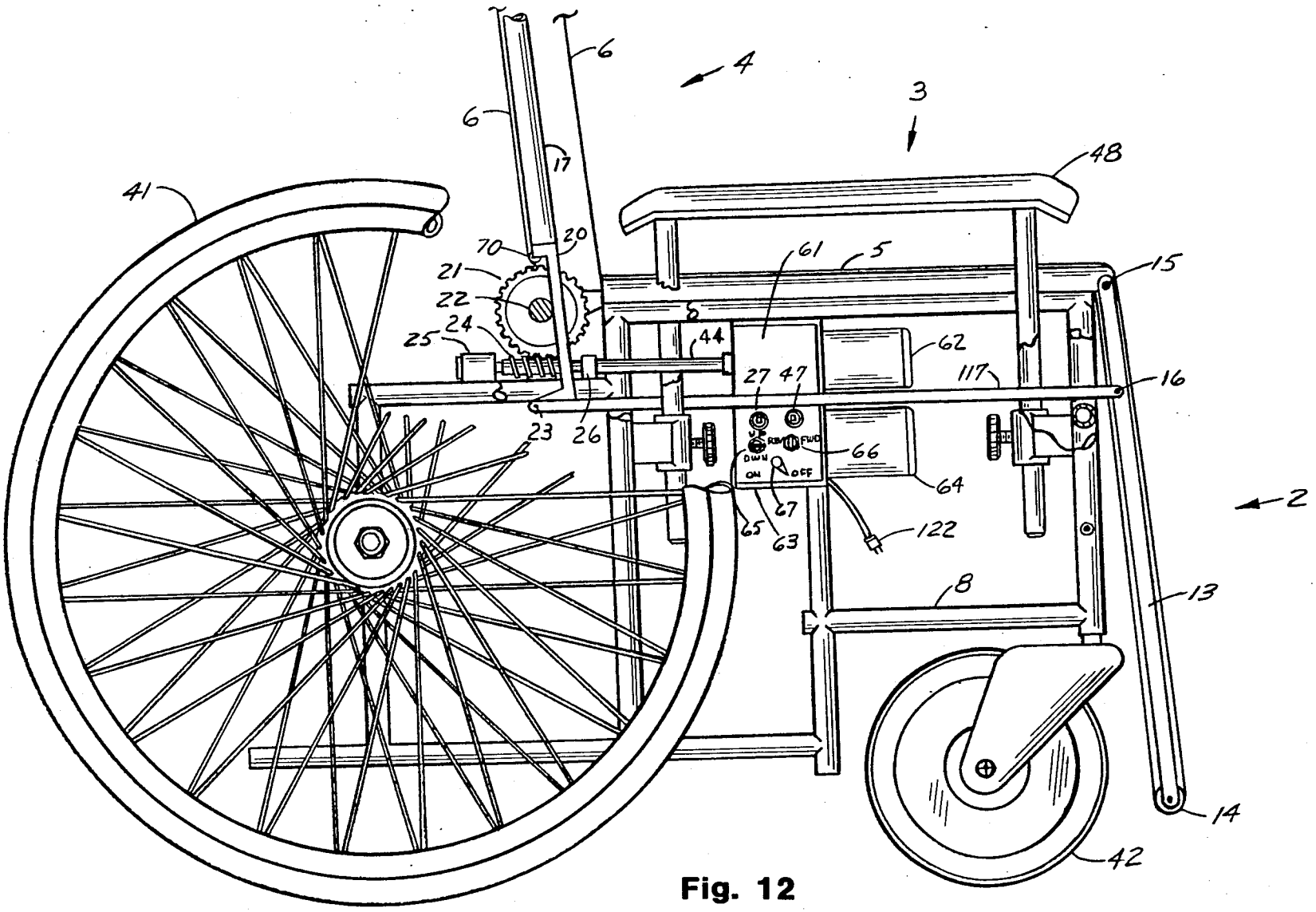
FIG. 12 a partial elevation section view of the wheelchair with electric motor drives for the elevating mechanism and belt.

FIG. 12 shows a wheelchair configuration similar to FIG. 3, except that electric motors rather than hand cranks are used to drive the back rest elevating mechanism and the transport belt. Motor 62 is connected to worm 37 (not shown) through gear box 61 to drive the belt, and motor 64 is similarly connected to worm 24 to elevate and lower the back and foot rests. Each of the two motors is controlled by a 3-position spring-returned momentary-action toggle switch, or equivalent, shown on control box 63, which may be mounted to gear box 61, as shown. When the switches are not deflected, the motors are off. Deflecting switch 65 upward runs motor 64 to drive the back rest up; deflecting switch 65 downward reverses the motor and lowers the back rest. Similarly, deflecting switch 60 to the right drives the belt 6 toward the right (i.e., toward the front of the wheelchair) and deflecting switch 60 to the left drives the belt left. A power on-off switch 67 is also provided for safety reasons. A cable and plug 122 connects to a power source (not shown), but described later. All the above motor switching and control circuitry is widely used and is well known to those skilled in the art.

In order to match the belt speed to the speed of a moving sheet on certain types of bed transport devices, a variable speed electric drive motor and control box may be needed on the wheelchair. In this case in FIG. 12, motor 62 is a variable speed reversible motor, and control box 63 is replaced by a new control box 115 shown in FIG. 12*a*, in which the momentary-action "Forward-Reverse" switch 66 is replaced by a conventional "Forward-Reverse" toggle switch 118 and a "Belt Speed" control knob 116 is fastened to a potentiometer (not shown). The associated motor speed control circuitry is similar to that commonly used for machine tools, such as variable speed drill presses and is well known to those skilled in the art. This circuitry may be packaged in control box 115 or elsewhere, as desired.

Any convenient power source can be used for the electric drives described above. Single phase 115v 60Hz power from a line cord 122 plugged into a conventional wall socket or a socket provided on the bed is the preferred configuration. Alternatively, batteries (not shown), which can be mounted on the wheelchair, can also be used.

Figure 12A:
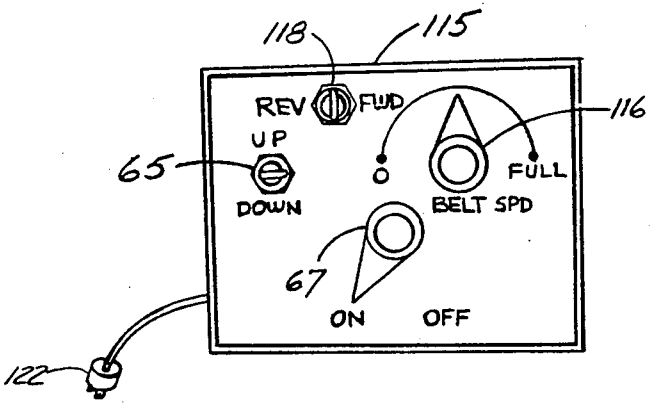
FIG. 12*a* is a side elevation view of the control box for a variable speed belt drive.

Although FIGS. 12 and 12*a* show electric drives for both the wheelchair elevating mechanisms and the belt drive, one of the drives could be manual and the other could be electric. For example the chair could be elevated manually, and the belt drive could be electric.

Figure 7A:
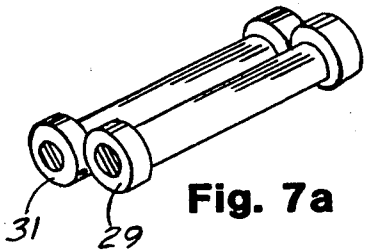
FIG. 7*a* is a perspective view of pinch drive rollers with reduced central diameters.
Figure 13:
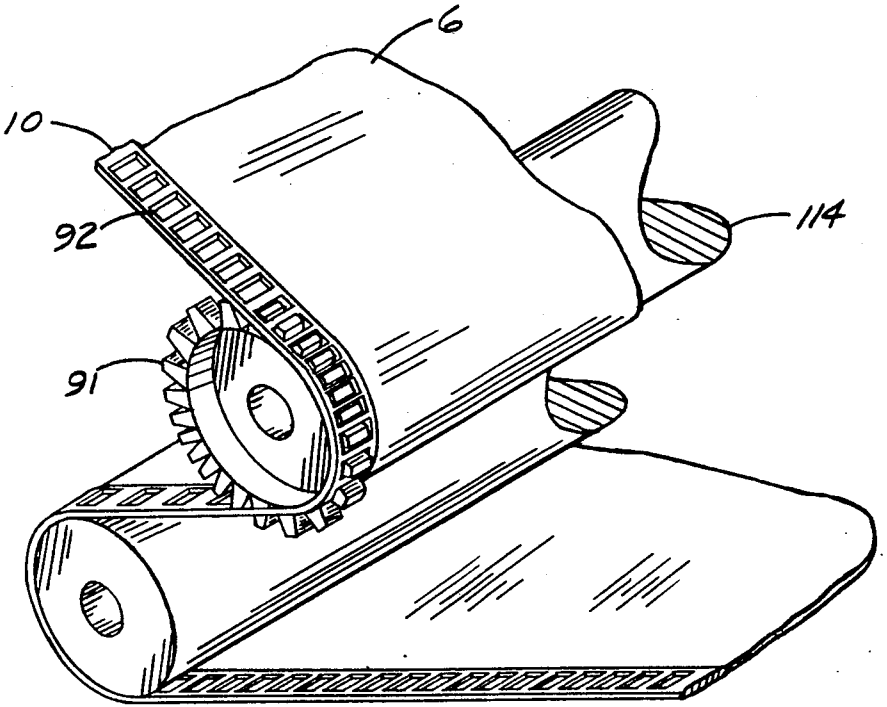
FIG. 13 is a partial perspective sectional view showing a sprocket drive for the belt in place of a roller drive.

Sprocket wheels with their teeth fitting through holes in a belt are commonly used for belt drives. A sprocket wheel (or tractor) drive is an alternative to the drive roller described above. It is used in another embodiment of this invention by replacing roller 29 by sprocket wheels or the equivalent which engage holes in opposite edges of belt 6. FIG. 13 shows one such sprocket wheel 91 with its sprockets passing through holes 92 in the thickened edge 10, of belt 6. Sprocket wheel 91 keyed to or otherwise attached to shaft 114, then replaces roller 29 in FIGS. 4 through 11. A second sprocket wheel 91 is attached to the other end of shaft 114 and engages holes on the opposite thickened edge 10 of belt 6. Rotation of the sprocket wheels will then propel belt 6. The sprocket wheels are driven by the same mechanism described above for driving roller 29. The sprocket wheel shaft 114 and the pressure roller 31 can both have reduced diameters in their center portions as shown in FIG. 7*a*.

When the wheelchair 1 is in an upright position as shown in FIG. 3, its general configuration is similar to that of a conventional manually self-propelled chair with a reclining seat back 4 (with the rear wheel 41 far enough back toward the rear of the chair to prevent the chair, when reclined, from tipping over backwards). The rear wheels 41 are shown large, while the front wheels are small and shown with casters, 42. However, as long as the proper wheel base is maintained for stability, the rear wheels may be any size as required, and either the front or rear wheels may be on casters. Brakes, which are standard on wheelchairs, are included, but are not shown on the drawings.

Removable arm rails 48 are shown in FIG. 3; these are desirable but not essential elements of the invention. Conventional foot rests which pivot out of the way to facilitate getting on and off a wheelchair are not shown, but can be mounted on the leg rest frame as on any wheelchair. Another type of foot rest is described later.

One of the objects of this invention is to provide access to a commode facility in the wheelchair or a toilet bowl located in a bathroom (not shown). FIG. 1 shows that belt 6 contains a toilet access hole 50 in the top surface of belt 6. A corresponding hole in the lower section of the belt is not visible because it is made much larger than the upper hole to avoid alignment and soiling problems. By positioning the belt properly before starting to transfer a person from the bed onto the wheelchair, the top hole can be positioned properly under the person so that continued motion of the belt will transport him such that his posterior is positioned over the toilet access opening or, in effect to the desired position on the wheelchair for using a commode or toilet. The wheelchair can then be unlatched from the bed and erected [uprighted] to a sitting position as explained earlier. It can then be moved over a toilet bowl, or the commode arrangement in the wheelchair can be utilized.

Figures 14, 14A:
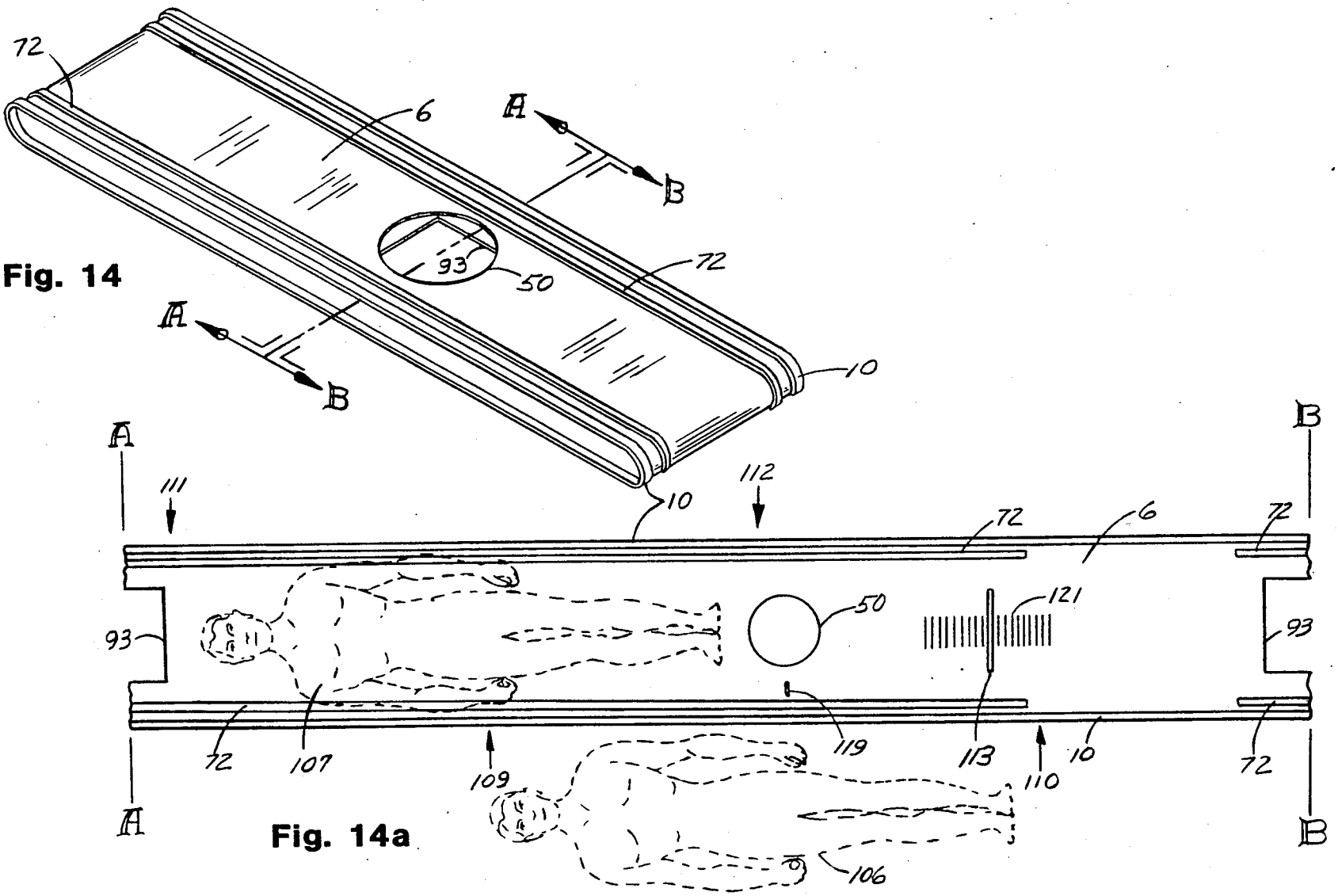
FIG. 14 is a perspective view of the transport belt showing the toilet access holes.
FIG. 14*a* is a plan view of the transport belt, cut and stretched out, and shows the positions of persons on the reclined wheelchair relative to the belt.

FIGS. 14 and 14*a* show schematically the belt and the relative positioning of a person on the belt during the use of the wheelchair. FIG. 14 shows a perspective view of belt 6 removed from the wheelchair but in the same position as in FIG. 1. In addition to toilet access opening 50, it shows the larger access opening 93 in the lower surface of the sheet.

FIG. 14*a* shows a top view of the belt 6 spread out after being cut approximately midway across the lower access opening 93. It shows schematically the longitudinal position relative to the belt 6 of a person 106 who has been transported onto the reclined chair to use a toilet. Under this condition, the positions of the belt 6 relative to the upper roller 19 and lower roller 14 (in FIG. 1) are indicated by arrows 109 and 110, respectively. Similarly, FIG. 14*a* also shows the longitudinal position relative to belt 6 of a person 107 who has been transported onto the reclined wheelchair for the purpose of normal sitting. Under this condition, the positions of the belt relative to the upper roller 19 and lower rollers 14 are indicated by arrows 111 and 112, respectively. In the latter case, both toilet access openings, 50 and 93, are beyond the rollers, out of the way on the lower surface of the chair. In the former case, after the back rest is raised and the foot rest lowered, the person will be sitting over access openings 50 and 93 as required.

A person can be transferred onto the wheelchair in a proper position for using the toilet facilities if the belt 6 is aligned to a correctly indexed position and is started moving just as the person's feet reach the top of the wheelchair. For proper indexing, a scale 113 may be inscribed on the belt.

As shown in FIG. 14*a*, if person 106 were being transferred onto the wheelchair so as to place his posterior over the small toilet access opening, his heels would fall on scale 113 at his "foot reference point" 121. This foot reference point can be corrected later if required. Foot reference point 121 can be used to position the belt 6 so that the person can be accurately transferred to this position on the belt as described below.

To transfer a person 106 from the bed to the wheelchair to use the toilet, belt 6 is positioned to place the selected foot reference point on scale 113 over upper roller 19. The transfer process is then started by switching on the sheet drive on the bed. When the feet of the person being transferred from the bed reach the top edge of the reclined wheelchair, the wheelchair belt drive is started, manually or automatically, and the belt 6 is propelled at approximately the same rate as the moving bed sheet. The belt is stopped when access opening index mark 119 is aligned with toilet seat index mark 120 on side guide rail 5, shown in FIG. 15*a*, and the wheelchair back is elevated.

A similar procedure can be used to transfer a person 107 to a normal sitting position on the wheelchair. Additional index marks can be provided for this case, but are not really needed. To start the transfer process, belt 6 is positioned to place the upper toilet access hole 50 several inches below the upper roller 19. The bed sheet drive is started, and the belt drive is started when the person's feet reach roller 19. Transfer will be completed by stopping belt 6 when the person's posterior reaches the toilet seat index mark 120, which marks the middle of the seating area 3.

In order to keep the person comfortable and in the desired position on belt 6, the belt speed is kept approximately the same as the sheet speed. This can be done by designing the sheet drive in the bed and the belt drive on the wheelchair to operate at the same rates. It is another embodiment of the invention, to operate with a bed whose sheet drive rate varies slowly over time, to provide a variable speed drive (on either the bed or the wheelchair) which is adjusted to match the belt speed with the sheet speed. This can easily be done as the person moves onto the wheelchair by manually or automatically (not shown) adjusting the relative speeds to stop any slippage that might occur between the moving person and the moving belt. A manual hand crank drive can be used as the variable drive if transfer speeds are slow, but a variable speed electric drive is the preferred implementation.

FIGS. 1, 14, and 14*a* show Velcro strips 72 which are sewn or otherwise fastened along the sides of belt 6. These strips can be used to attach a variety of different pads to the belt such as a washable cloth pad, a waterproof protection pad, a waterproof protection pad which has a cutout to match the toilet access opening and which serves as a replaceable toilet seat, a cushion, a cover pad for covering the toilet access opening, and different types of cushioning pads for protection against bedsores (decubitus ulcers) including gel pads. One such pad 73 is shown in FIG. 1 with Velcro strips which allow it to be attached to the belt. If the pad 73 is flexible so that it can pass over the upper wheelchair roller 19, the pad can be positioned so that it will be moved under a person as he is transported onto the wheelchair.

Alternatively, the Velcro strips 72 can be located in strips across belt 6, or in short sections at selected locations along the sides of belt 6 or in other arrangements as desired, or other means such as snaps, zippers, lacing, etc. can be used to fasten the pads to the belt. When pads are used on belt 6, if unrestricted belt travel is desired, the pressure roller 31 and drive roller 29 (or the drive sprocket shaft 114 in FIG. 13) must have the shape shown in FIG. 7*a* to allow the pads to pass between the rollers.

Figure 15A:
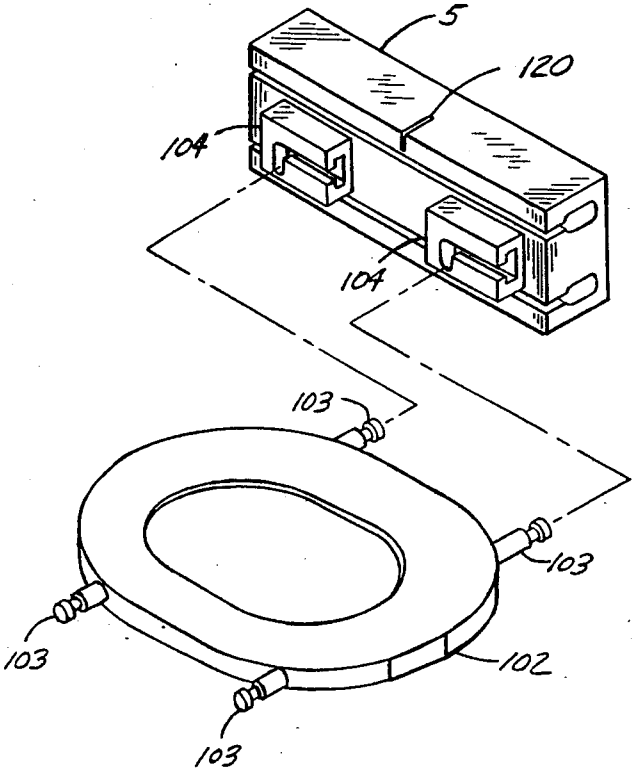
FIG. 15*a* is a partial perspective view of the toilet seat and its mounting arrangement.
Figure 15:
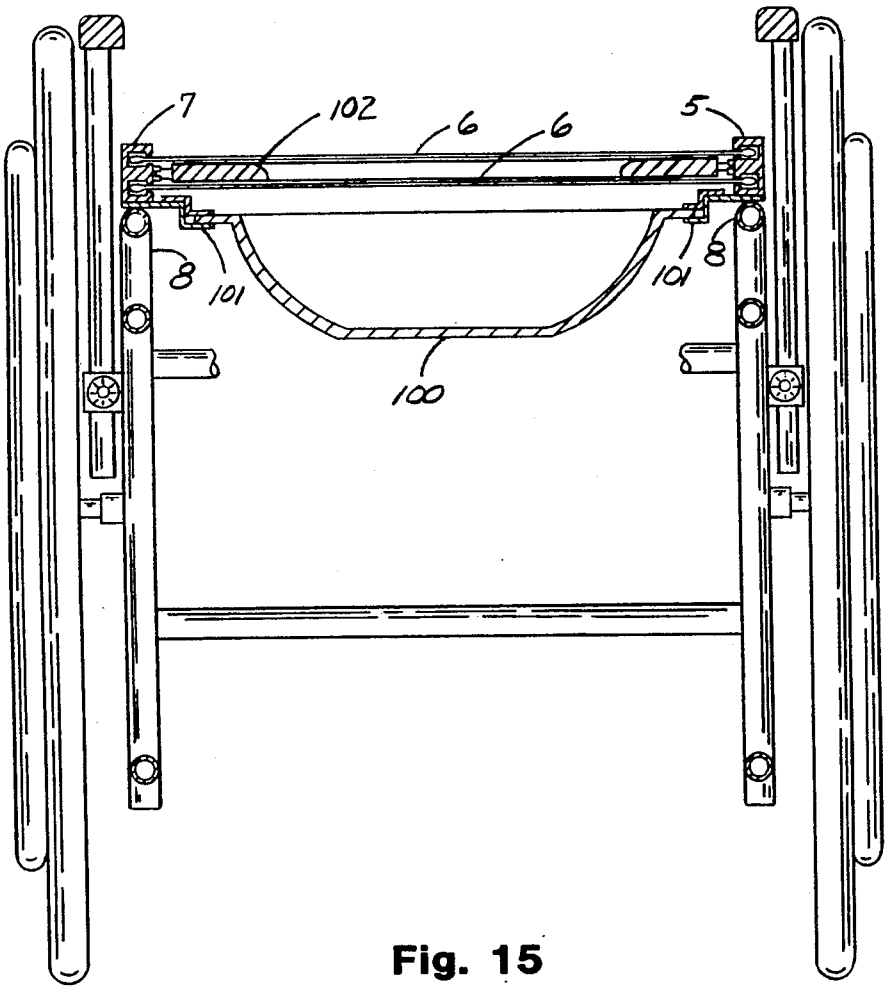
FIG. 15 is a partial rear elevation section view of the wheelchair showing the toilet seat and chamber pot arrangement.

The optional commode arrangement in the wheelchair is shown in FIG. 15, which is a partial sectional view of the seat portion of the wheelchair from the rear. It shows a chamber pot 100 held by support slide brackets 101 which are clamped between the side guide rails 7 and the side tubes of the frame 8 on each side of the seat. The chamber pot 100 slides out toward the rear for removal.

A toilet seat 102 is shown in FIG. 15 mounted between the upper and lower layers of the belt 6, and is shown in perspective in FIG. 15*a*. This toilet seat 102 is designed to support a significant portion of the weight of a sitting person from its position under the full belt surface during normal use of the wheelchair as well as under the toilet access opening during use of the toilet facility.

The toilet seat 102 is supported by 4 shoulder pins 103 which are embedded in it and which slide into and are held securely by support brackets 104 as shown on FIG. 15*a*. The support brackets 104 are mounted by screws or otherwise fastened to side rails 7 on each side of the wheelchair. The toilet seat 102 can be removed for cleaning through the larger opening 93 in the belt 6. In the same way, a special support cushion or flat or curved seat, with or without a cushioned surface, which is equipped with shoulder pins 103 can be inserted in place of the toilet seat, if desired.

Conventional wheelchair foot rests can be mounted on the leg rest assembly 2 as indicated earlier. However, because the knee pivot point of a person reclining on the extended wheelchair is above and forward of the pivot point 15 of the wheelchair leg rest assembly 2, a foot rest mounted to the leg rest would not be positioned properly for both the sitting and reclining positions of the wheelchair.

Figure 16A:
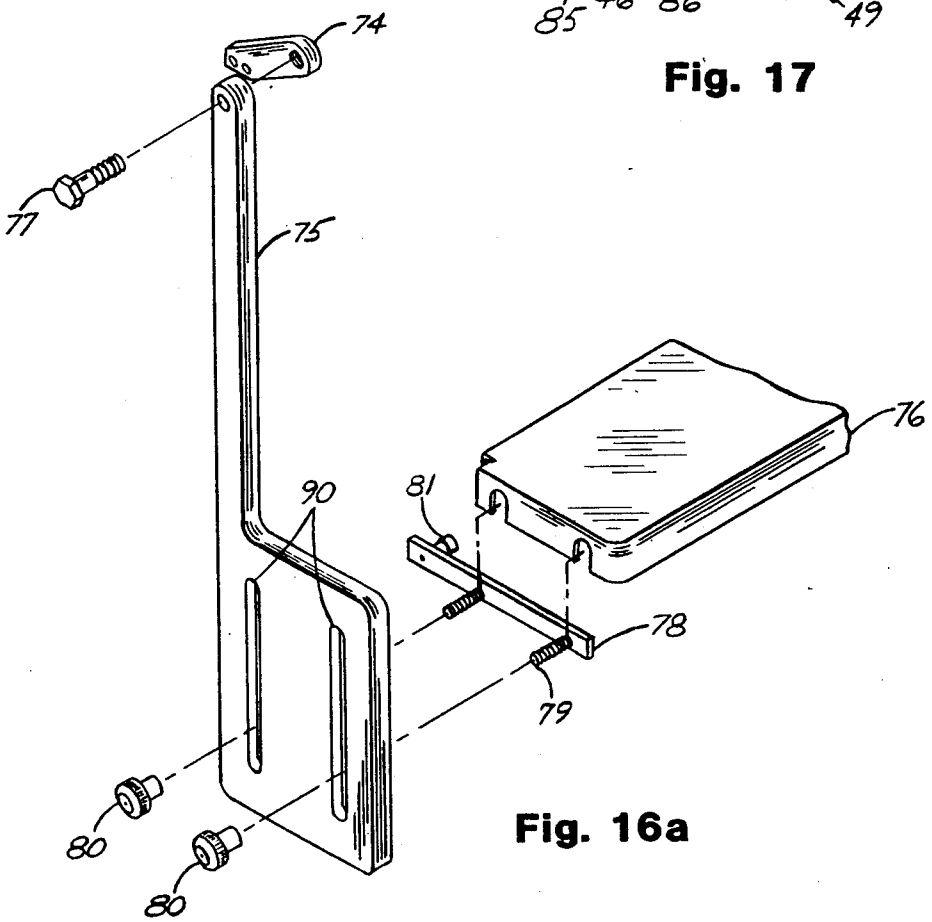
FIG. 16*a* is an exploded perspective view of the foot rest.
Figure 16:
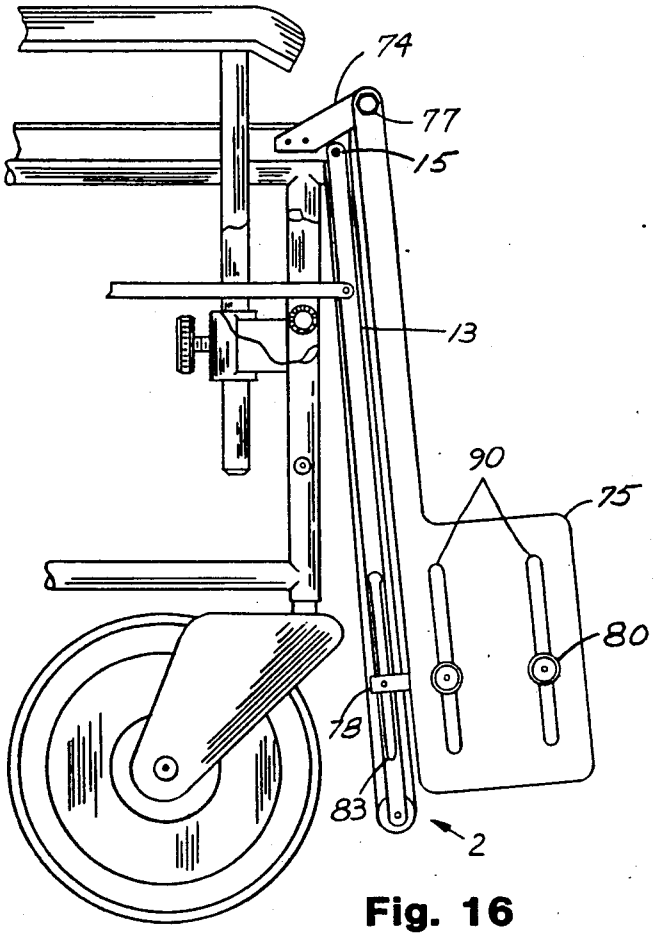
FIG. 16 is a partial elevation view of the front portion of the wheelchair showing the leg rest and a foot rest.

FIGS. 16 and 16*a* show an improved foot rest arrangement solves this problem by providing a pivot axis 77, and is forward of and above the foot rest assembly pivot 15. On each side of the wheelchair a foot rest assembly 75 is held by, and pivots around, pivot bolt 77, which screws into bracket 74. Bracket 74 is bolted, riveted or otherwise fastened to side guide rail 5 and 7. The foot rest 76 which extends across the wheelchair is held on each side by knurled nuts 80 on threaded studs 79 which pass through adjustment slots 90 in foot rest supports 75. The threaded studs 79 are welded or otherwise fastened to a slide bar 78 over which the foot rest 76 fits. Shouldered stud 81 on slide bar 78 fits into, and is constrained to slide in, slot 83 in the leg rest frame 13. The foot rest 76 can be adjusted to the desired length after loosening knurled nuts 80. When the leg rest assembly 2 is raised, foot rest 76 will slide toward foot roller 14 and so will be close to an optimum position when the chair is in either a sitting or a reclined position.

Figure 17:
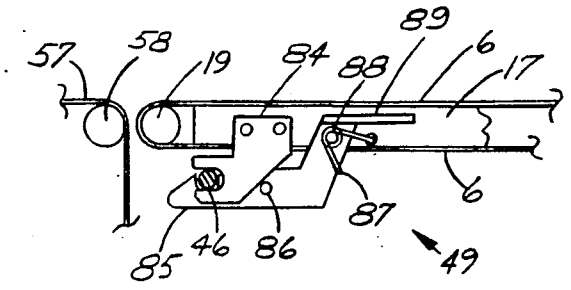
FIG. 17 is an elevation view of the latching mechanism.

FIG. 1 shows the wheelchair 1 latched to the bed 52 for the purpose of transfering a person between the two. FIG. 17 is a side elevation view of the latching mechanism 49, mounted on one side of the back rest frame 17, near the upper roller 19. A similar latching mechanism is mounted on the opposite side of the backrest. The latching mechanism is shown latched to bar 46, which is rigidly mounted on the bed as shown in FIG. 1 (not shown in FIG. 17). The latching mechanism consists of latch 84 pushed onto bar 46 as shown. Latch 85 pivots about pin 88, and when the wheelchair is not latched, latch 85 is held in position by pin 86 against latch 84 by spring 87. As the wheelchair is moved against bar 46, latch 85 is deflected downward until latch 84 is seated around the bar. At that point latch 85 springs up and latches onto bar 46 as shown. The wheelchair is then locked to and supported by bar 46. Handle 89 is used to tip the latch down to release the bar.

Figure 19:
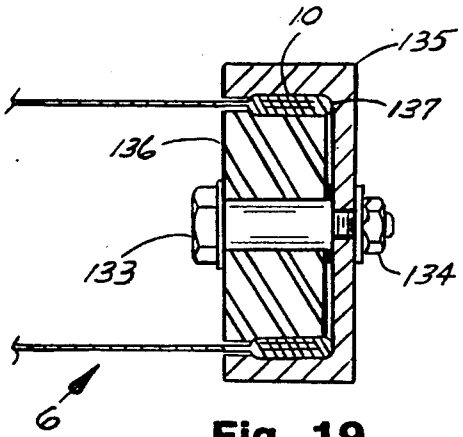
FIG. 19 is a partial front cross sectional view of another upper roller arrangement designed for greater comfort.

An important object of this invention is to provide comfort to a person being transferred between bed and wheelchair. In order to minimize discomfort to a person passing over upper roller 19, this roller may be made with an outer layer of soft rubber-like material, rather than hard material. Other embodiments of the invention to provide even greater comfort are shown in FIGS. 18, 18*a* and 19.

Figure 18:
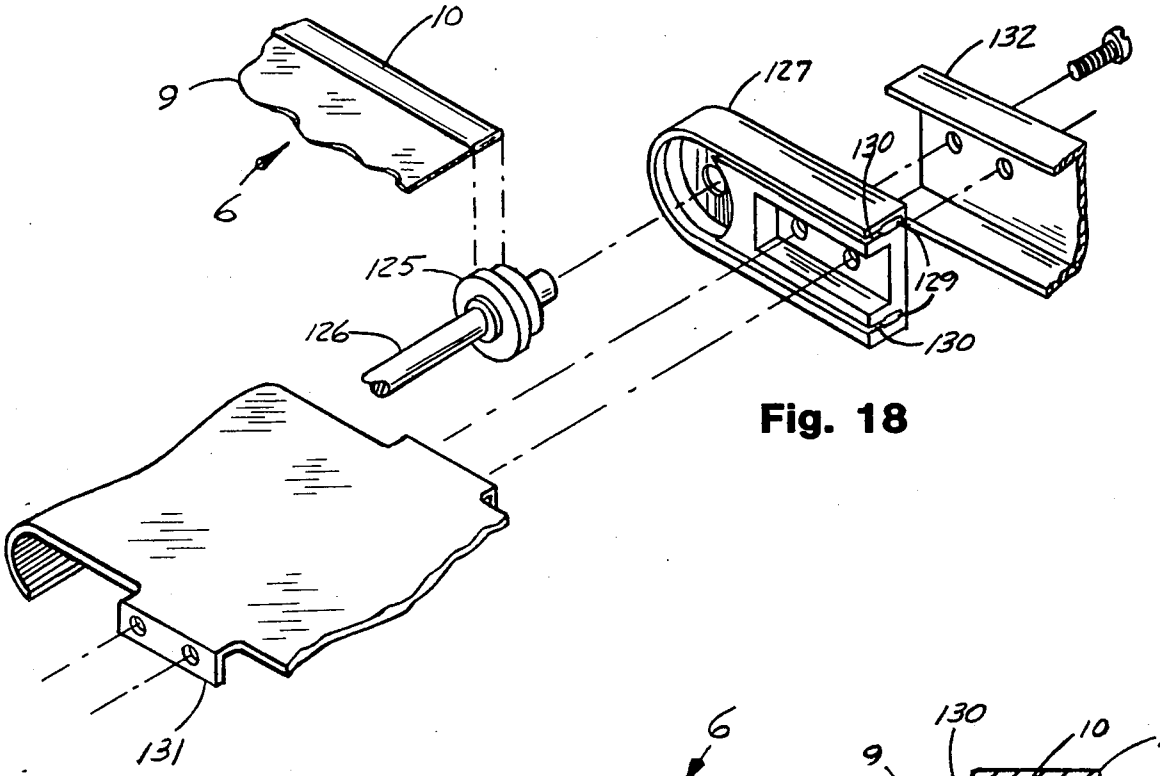
FIG. 18 is a partial perspective exploded view of the major parts of an upper roller arrangement designed for greater comfort.
Figure 18A:
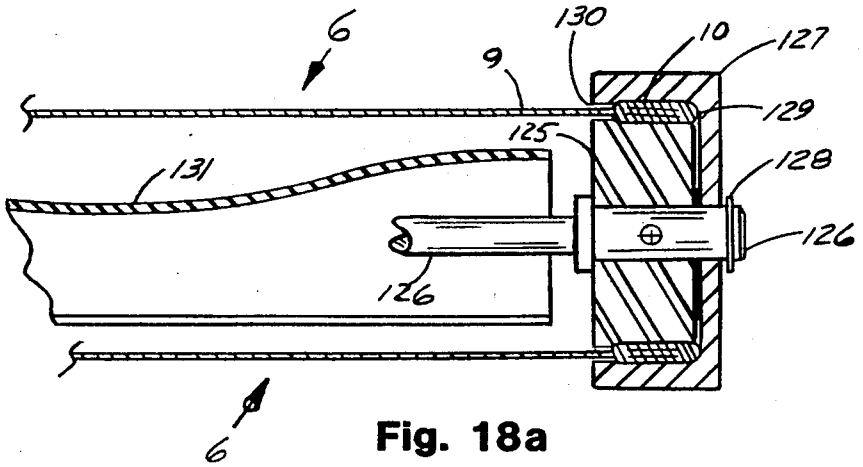
FIG. 18*a* is a partial front cross sectional view of this upper roller arrangement.

FIG. 18 shows a partial perspective exploded view of the major parts of an upper roller assembly arrangement which can be used in place of upper roller 19. FIG. 18*a* is a partial front cross sectional view of this assembly through the axis of the roller with the wheelchair reclined.

FIG. 18 shows that the left edge of sheet 6 passes around upper roller 125, with the thickened edge 10 supported by a shoulder on roller 125 and part of the thinner central portion of the sheet supported by a larger diameter flange on roller 125. The roller 125 is fastened to a shaft 126 by a set screw or other means, and the end of the shaft 126 projects through an upper guidance block 127 and is secured by a split retaining ring 128 or by other means.

Figure 6:
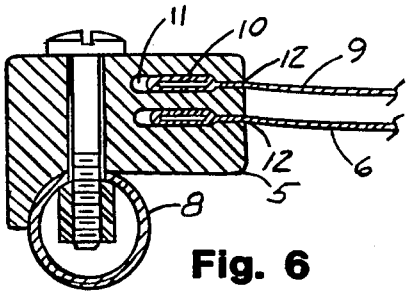
FIG. 6 is partial section through a side of the seating area from FIG. 3 and shows the method of supporting the transport belt by the side guide rail.

FIG. 18 shows that the upper guidance block 127 is similar to side guidance block 7 shown in FIG. 6 in that it contains a guidance groove 129 with a large inner portion through which the thickened edge 10 of belt 6 slides and in which it is constrained, and a thin slot 130 through which the thinner central portion 9 of belt 6 slides. During transfer of a person onto the wheelchair, belt 6 enters the lower portion of guidance groove 129, passes around roller 125 and exits from the upper portion of guidance groove 129. FIG. 18*a* shows that where the sheet passes around roller 125, the roller forms a moving inner portion of guidance groove 129 and guidance block 127 forms the fixed outer portion of groove 129.

It is apparent from FIG. 18*a* that when a person is lying on belt 6, as he is transported onto the wheelchair, his weight will be supported by belt 6 and will cause it to sag. As shown in FIG. 18, a smooth semi-rigid platen 131 is bolted or otherwise fastened to upper guidance block 127 to provide additional support to belt 6, when needed, and to prevent discomfort which might be caused if belt 6 were forced down onto shaft 126 by the person's weight.

Upper guidance block 127 is bolted or otherwise fastened to the back rest frame 132, which is equivalent to back rest frame 17 in FIG. 3, except for differences in mounting provisions for the upper roller 19 and guidance block 127.

FIGS. 18 and 18*a* show the left side parts of the upper roller arrangement. The right side parts (not shown) are similar or equivalent.

FIG. 19 is a partial front cross sectional view similar to FIG. 18*a* of a modified arrangement in which upper roller shaft 126 is eliminated and roller 136 is supported by and rotates on shaft 133, which has a threaded end and is firmly secured by a nut 134 to guidance block 135. The latter is similar to guidance block 127. In this arrangment, platen 131 may be deleted, in which case the sizes of the thickened edges 10 of belt 6 and guidance grooves 137 would, in practice, be increased to support greater weight.

FIG. 19 also represents an alternative arrangement in which roller 136 is fixed to shaft 133 held by guidance block 135 to form a fixed semi-circular groove through which the thickened edge 10 of the sheet slides.

Although the wheelchair described herein has no provisions for electric propulsion, there is no intent to limit the invention to manually propelled wheelchairs. It is clear that motorized wheelchairs have reached an advanced state of development and that all of the devices described above can also be incorporated in a motorized wheelchair.

I claim:

1. A reclinable wheelchair comprising: a back rest section, a seat section, and a leg rest section; conversion means for converting the wheelchair surface between an upright chair position and a reclined wheelchair position having an extended horizontal surface; means for positioning said wheelchair in said reclined position end-to-end with a support on which a person lies; said wheelchair having a continuous belt of flexible material passing over rollers near head and foot ends of said wheelchair; said belt comprising top and bottom surfaces of said wheelchair; constraining means for supporting said belt in a selected position on the wheelchair; rotational means for propelling said belt in either direction; propelling power means for driving said rotational means; a roller at the head end of said wheelchair and comprising two flanged rollers, one flanged roller being located on each side of the wheelchair; a shaft for mounting each flanged roller, each flanged roller being rotatable freely on said shaft within a cylindrical cavity, said cavity and flanged roller forming together a guidance groove having a narrow outer slit and a wider inner groove, said guidance groove being shaped so that a belt with thickened edges passes around the roller with a thickened edge of said belt passing through said wider inner groove, said belt having a relatively thinner center portion passing through said narrow outer slit.

2. A reclinable wheelchair as defined in claim 1, including a semi-rigid member fixed to the wheelchair and positioned below a top surface of the belt between said flanged rollers for supporting said belt.

3. A person transfer system comprising: a reclinable wheelchair positioned end-to-end with a bed; said wheelchair having a back rest section, a seat section, and a leg rest section; conversion means for converting wheelchair surface between an upright chair position and a reclined wheelchair position with an extended horizontal surface; means for positioning said wheelchair in reclined position end-to-end with a bed; said wheelchair having a continuous belt of flexible material passing around belt support means at at least the head and foot ends of said wheelchair and forming the top and bottom surfaces of the wheelchair; belt driving means to propel the belt in either direction; said bed having a sheet of material on which a person may lie; said sheet extending across a mattress between, and partially rolled up on, rollers near head and foot ends of the bed; sheet driving means on the bed to roll the sheet onto one said roller and unroll the sheet from the other said roller for moving the sheet across the mattress; control means acting on the sheet driving means and said belt driving means to control speeds and directions of the sheet and belt for moving a supine person between the bed and wheelchair.

4. A person transfer system as defined in claim 3, wherein said belt driving means includes a gear train connected to sprocket wheels having teeth engaging holes in said belt.

5. A person transfer system as defined in claim 3, wherein said belt driving means includes a gear train connected to a drive roller with means for maintaining predetermined pressure between said drive roller and said belt.

6. A person transfer system as defined in claim 5, wherein said means for maintaining predetermined pressure between said drive rollers and said belt comprises a second roller; said belt passing between the surface of said drive roller and said second roller.

7. A person transfer system as defined in claim 6, including a roller contacting an outer surface of said belt, said roller having a larger diameter in sections under an edge of said belt than at other locations on said belt.

8. A person transfer system as defined in claim 3, wherein said belt driving means includes a hand crank.

9. A person transfer system as defined in claim 3, wherein said control means comprises on-off and direction controls for said belt and sheet driving means.

10. A person transfer system as defined in claim 3, wherein said control means includes variable speed motor control.

11. A person transfer system as defined in claim 3, wherein said conversion means comprises; a gear train connected to said back rest section; and linkage means connecting said back rest section and said leg rest section, so that when said back rest section is lowered, said linkage means raises said leg rest section; and conversion power means for driving said gear train.

12. A person transfer system as defined in claim 11, wherein said conversion power means comprises a hand crank.

13. A person transfer system as defined in claim 11, wherein said conversion power means comprises a motor.

14. A person transfer system as defined in claim 3, wherein said means for positioning said wheelchair end-to-end with a bed comprises: wheels with casters on said wheelchair; and means on said wheelchair connected with a member on said bed to support and hold said wheelchair fixed to said bed.

15. A person transfer system as defined in claim 3, wherein said belt support means includes support material connected between structural members of said wheelchair, said material being positioned below an upper portion of said belt.

16. A person transfer system as defined in claim 3, wherein said belt support means includes idler rollers.

17. A person transfer system as defined in claim 3, wherein said belt support means includes a belt with thickened edges and edge guidance members; said belt with thickened edges sliding through guidance grooves in said edge guidance members, said guidance members being positioned along each side of said wheelchair, each guidance groove having a narrow outer slit, said belt having center portion passing through said slit, said guidance groove having a wider inner groove, said thickened edge of said belt passing through said wider inner groove.

18. A person transfer system as defined in claim 3, wherein said belt contains two large toilet access openings positionable one above the other in said seat section of said wheelchair.

19. A person transfer system as defined in claim 18, including a further replaceable seat with attachment means below a top layer of said belt; and replaceable seat having a shape, firmness and strength for supporting comfortably a person seated on said wheelchair.

20. A person transfer system as defined in claim 18, including a replaceable chamber pot with attachment means.

21. A person transfer system as defined in claim 18, including a scale inscribed on a surface of said belt for positioning said belt when transferring a person onto said toilet access openings.

22. A person transfer system as defined in claim 3, wherein said belt has a center portion comprising a flexible sheet-like material.

23. A person transfer system as defined in claim 3, wherein said belt has a center portion including attachment means for wheelchair accessories.

24. A person transfer system as defined in claim 23, wherein said attachment means comprises strips on said belt that form a closure when in contact and become opened when the strips are pulled apart.

25. A person transfer system as defined in claim 23, including a replaceable pad attached to said belt.

26. A person transfer system as defined in claim 3, wherein a roller at the head end of said wheelchair has an outer layer of soft material.

27. A person transfer system as defined in claim 3, wherein a belt support roller at the head end of said wheelchair comprises two flanged rollers, one flanged roller being located on each side of the wheelchair; a shaft for mounting each flanged roller, each flanged roller being rotatable freely on said shaft within a cylindrical cavity, said cavity and flanged roller forming together a guidance groove having a narrow outer slit and a wider inner groove, said guidance groove being shaped so that a belt with thickened edges passes around the roller with a thickened edge of said belt passing through said wider inner groove, said belt having a relatively thinner center portion passing through said narrow outer slit.

28. A person transfer system as defined in claim 27, including a semi-rigid member fixed to the wheelchair and positioned below a top surface of the belt between said flanged rollers for supporting said belt.

29. A person transfer system as defined in claim 3, wherein said belt is free of said belt driving means and moves freely around said belt support means of said wheelchair by low friction surfaces.

30. A person transfer arrangement comprising: a reclinable wheelchair positioned end-to-end with a bed; said wheelchair having a back section, a seat section, and a leg rest section: means for converging said wheelchair from an upright chair position to a reclined position with an extended horizontal surface; said wheelchair having a strip of material extending over its surface; means for positioning said wheelchair in reclined position end-to-end with a bed; said bed having a mattress with a sheet of material thereon on which a person may lie; sheet moving means for pulling the sheet of material over the mattress; said sheet moving means comprising rollers near head and foot ends of the bed and sheet driving means on the bed to roll the sheet onto one said roller and unroll the sheet from the other said roller for moving the sheet across the mattress; strip moving means for moving said strip of material over said wheelchair so as to transfer a supine person between the bed and the wheelchair; said strip moving means differing from said sheet moving means.

31. A person transfer system comprising: a reclinable wheelchair positioned end-to-end with a bed and having a wheelchair surface; said wheelchair having a back rest section, a seat section, and a leg rest section; conversion means for converting said wheelchair surface between an upright chair position and a reclined wheelchair position with an extended horizontal surface; means for positioning said wheelchair in reclined position end-to-end with a bed; said wheelchair having a strip of material extending over its surface; said strip of material being free of motor means; said bed having a sheet of material on which a person may lie; said sheet extending across a mattress between, and partially rolled up on, rollers near head and foot ends of the bed; sheet driving means on the bed to roll the sheet onto one said rollers and unroll the sheet from another said rollers for moving the sheet across the mattress; control means acting on said sheet driving means to control speed and direction of the sheet for moving a supine person between the bed and wheelchair; said strip having roller means and a low friction surface for moving freely with velocity of said person being moved by said sheet between said bed and said wheelchair.

* * * * *